United States Patent [19]

Eptaminitakis

[11] Patent Number: 4,634,389

[45] Date of Patent: Jan. 6, 1987

[54] VESSEL HAVING DEMOUNTABLE SUBMERGED PROPELLER UNIT

[75] Inventor: Yannis Eptaminitakis, London, England

[73] Assignee: Vickers Public Limited Company, London, England

[21] Appl. No.: 694,011

[22] Filed: Jan. 23, 1985

[30] Foreign Application Priority Data

Jan. 25, 1984 [GB] United Kingdom ..... 8401879

[51] Int. Cl.[4] ..... B63H 25/42

[52] U.S. Cl. ..... 440/53; 440/54; 440/62; 440/64

[58] Field of Search ..... 440/53, 49, 54, 58, 440/62–64, 55, 67, 66; 114/150, 144 B

[56] References Cited

U.S. PATENT DOCUMENTS

| | | | |
|---|---|---|---|
| 1,774,956 | 9/1930 | Wilson | 440/58 |
| 2,586,019 | 2/1952 | Frohlich | 440/58 |
| 4,046,096 | 9/1977 | Liaaen | 440/58 |

FOREIGN PATENT DOCUMENTS

| | | | |
|---|---|---|---|
| 2702139 | 7/1977 | Fed. Rep. of Germany | 440/62 |
| 2313261 | 12/1976 | France | 440/62 |
| 983462 | 2/1965 | United Kingdom | 440/58 |

*Primary Examiner*—Trygve M. Blix
*Assistant Examiner*—Edwin L. Swinehart
*Attorney, Agent, or Firm*—Shoemaker and Mattare, Ltd.

[57] ABSTRACT

The invention concerns a hull and a submerged propeller unit demountably fitted to the hull and continuously rotatable through 360° of azimuth relative to the hull to give full thrust in any required direction. An aperture in the hull is surrounded by a fixing flange to which extend a drive input shaft for the propeller unit and at least one steering drive shaft. At least one steering drive motor is mounted in the vessel and is connected to the steering drive shaft to effect rotation thereof. A gearbox casing of the propeller unit fits in the aperture with a circumferential flange releasably bolted to the fixing flange. A stem depends from said casing and is rotatably supported therein at its upper end to act as a steering tube for a propeller rotatably supported at its lower end. A steering gear wheel in said casing through which the stem passes and to which it is secured effects rotation thereof. Steering drive gear means rotatably supported in said casing in mesh with the steering drive wheel is releasably connected to said steering drive shaft so that operation of said steering motor rotates the propeller unit. A drive transmission shaft for the propeller extends through the stem is releasably connected at its upper end to the main drive shaft whereby when the propeller unit is dismounted from the vessel the steering gear wheel and the gear means are removed in the casing as part of the demountable propeller unit.

11 Claims, 6 Drawing Figures

VESSEL HAVING DEMOUNTABLE SUBMERGED PROPELLER UNIT

FIELD OF THE INVENTION

This invention relates to a vessel having a hull and a demountable submerged propeller unit.

BACKGROUND OF THE INVENTION

Demountable propeller units or so-called thrusters that are useful for vessels such as floating oil drilling rigs and are installed deep below the water surface are described in UK patent specifications No. 1551061-1551063. It is an object of the invention to provide units of the present kind that are steerable in azimuth but can be removed and replaced underwater with a minimum amount of work.

SUMMARY OF THE INVENTION

Broadly stated the invention provides a vessel having a hull and a submerged propeller unit demountably fitted to the hull and continuously rotatable through 360° of azimuth relative to the hull to give full thrust in any required direction, comprising an aperture in the hull of the vessel surrounded by a fixing flange and to which extend a drive input shaft for the propeller unit and at least one steering drive shaft, at least one steering drive motor mounted in the vessel and connected to the steering drive shaft to effect rotation thereof, a casing that fits in the aperture with a circumferential flange releasably bolted to the fixing flange, a stem depending from said casing and rotatably supported therein at its upper end to act as a steering tube for a propeller rotatably supported at its lower end, a steering gear wheel in said casing through which the stem passes and to which it is secured so as to effect rotation thereof, steering drive gear means rotatably supported in said casing in mesh with the steering drive wheel and releasably connected to said steering drive shaft so that operation of said steering motor rotates the propeller unit, and a drive transmission shaft for the propeller extending through the stem and releasably connected at its upper end to the main drive shaft whereby when the propeller unit is dismounted from the vessel the steering gear wheel and the gear means are removed in the casing as part of the demountable propeller unit.

BRIEF DESCRIPTION OF DRAWINGS

Various embodiments of the invention will now be described by way of example only with reference to the accompanying drawings, in which:

DETAILED DESCRIPTION OF PREFERRED EMBODIMENT

Figure 1:
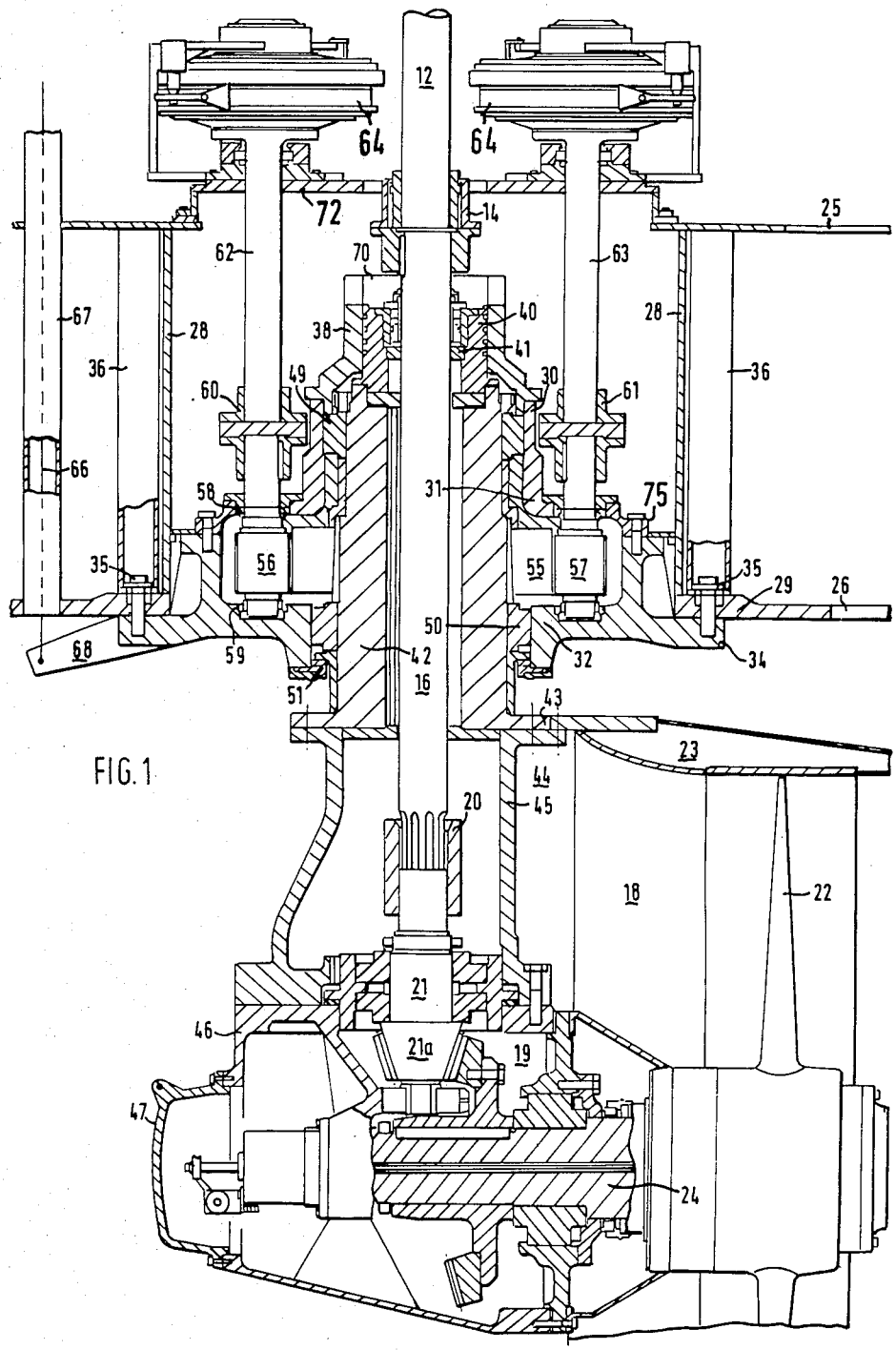
Figure 2A:
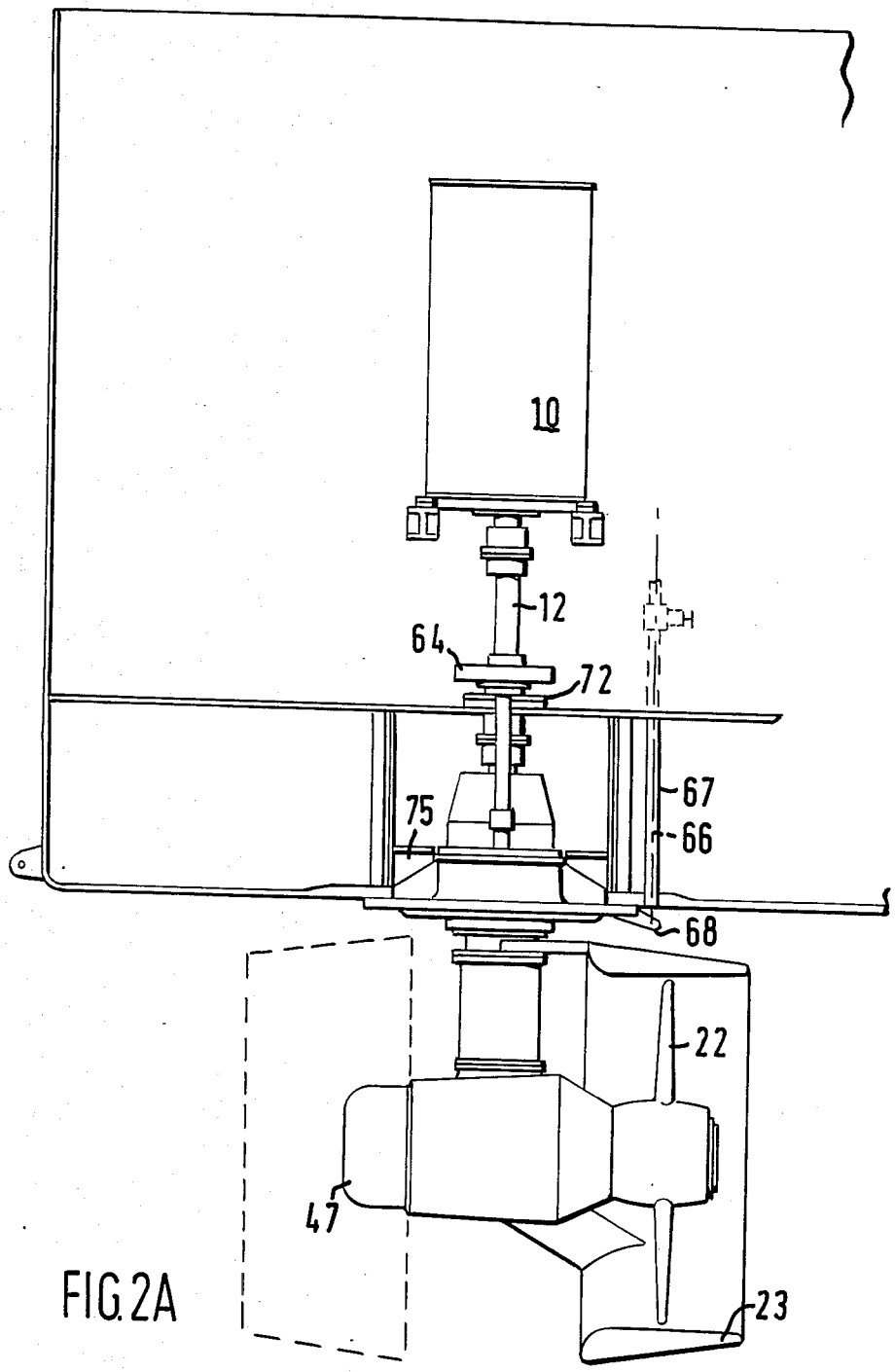
Figure 2B:
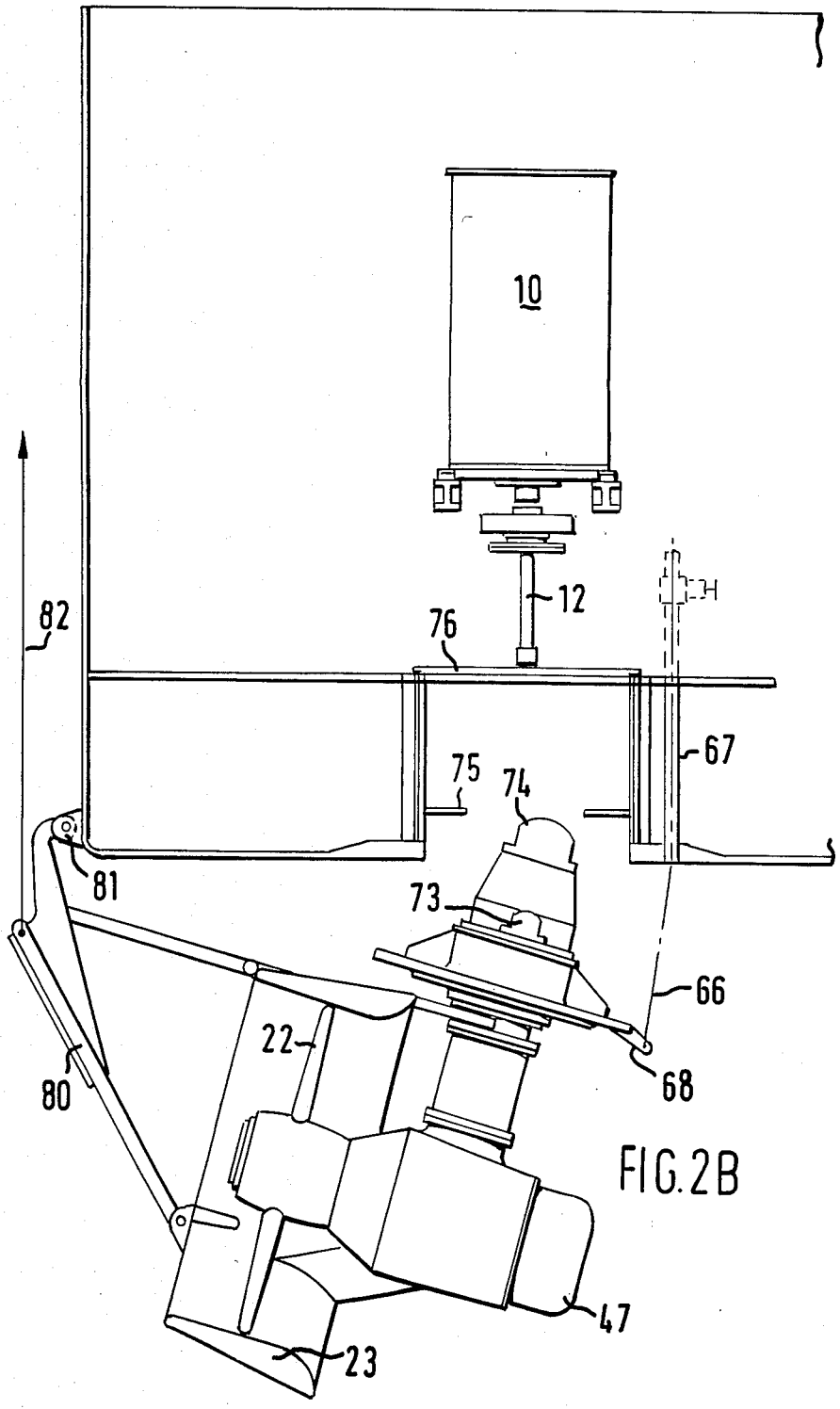
Figure 3A:
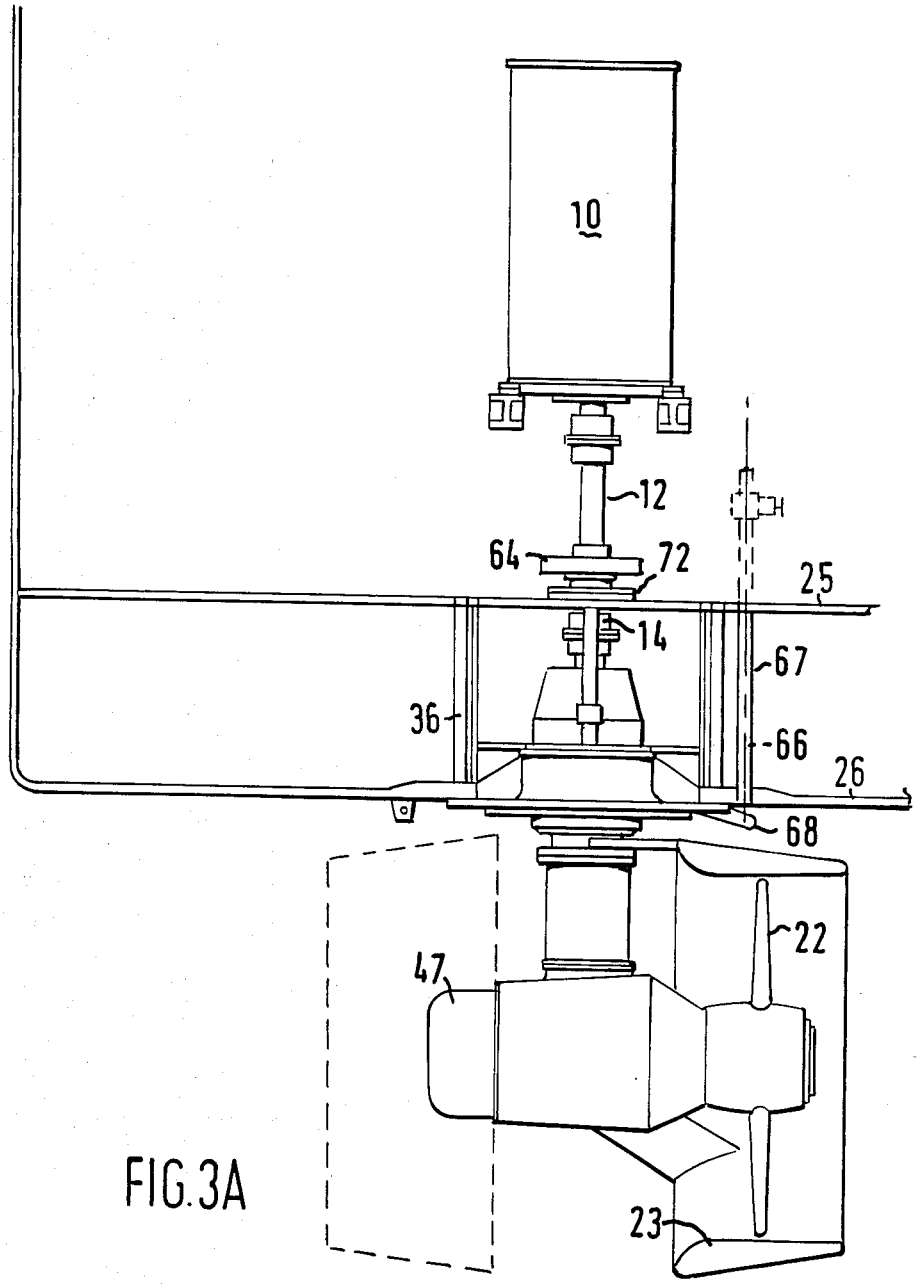
Figure 3B:
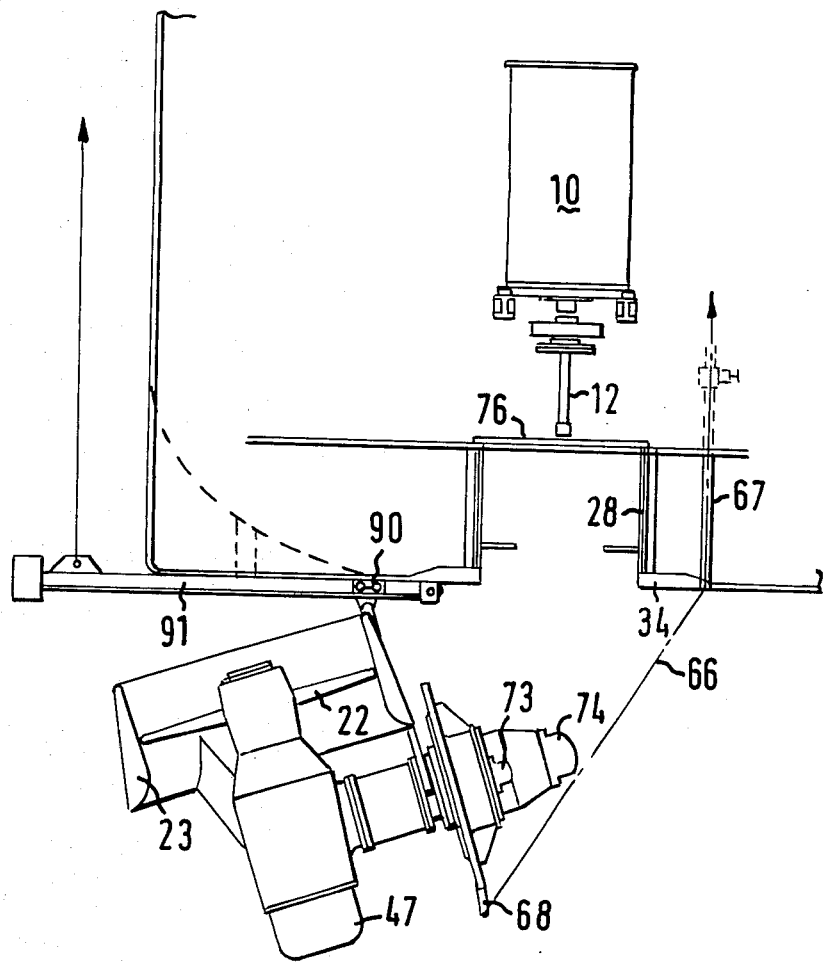
Figure 3C:
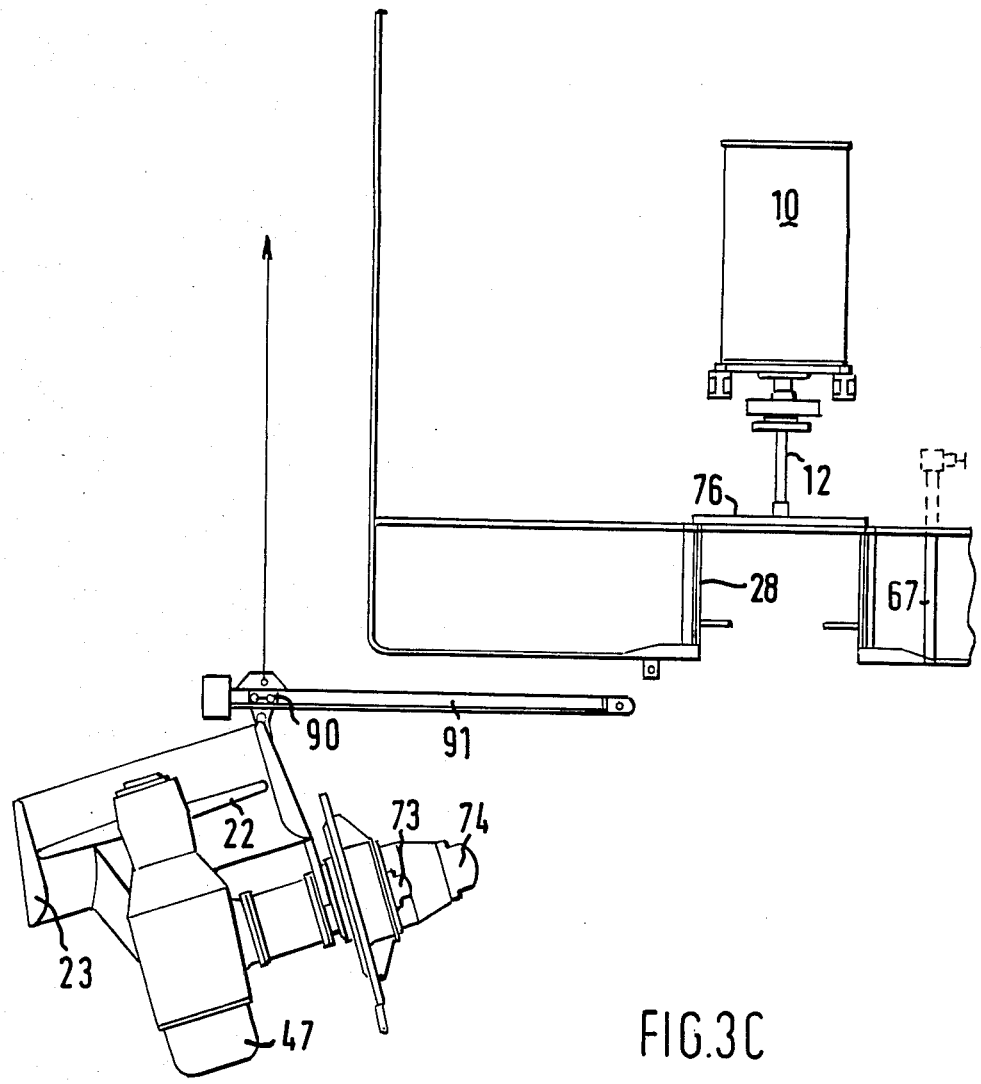

FIG. 1 is a diagrammatic section of an azimuth thruster according to the invention;

FIGS. 2A and 2B show successive steps in the demounting of a thruster as shown in FIG. 1 from the bottom of a vessel;

FIGS. 3A to 3C show successive steps in demounting a thruster as shown in FIG. 1 using an alternative support system.

FIG. 1 shows an azimuth thruster unit consisting of a controllable pitch thruster assembly having a nozzle attached to a rotatable stem that enables the propeller to be rotated continuously through 360 degrees about a vertical axis, thereby giving full thrust in any direction. Drive from a prime mover 10 which may be an electric motor having a depending output shaft passes to intermediate drive shaft 16 of the azimuth thruster unit generally designated by the reference numeral 18 via drive shaft 12 and gear coupling 14 which accommodates a degree of shaft misalignment. The shaft 16 terminates in a rigid coupling 20 that connects to a bevel gear pinion shaft 21 of a thruster lower gear box. The thruster unit has a nozzle 23 attached thereto by the main stem and by two lower stays disposed 120 degrees apart about the axis of the propeller unit 22. The propeller unit 22 consists of a controllable pitch propeller with hub and blades manufactured in a high strength material (eg. manganese aluminium bronze, nickel aluminium bronze or a suitable stainless steel) which is bolted to a flanged propeller shaft 24 that in turn is driven from the pinion **21*a* at the base of shaft 21 by means of a gear 19 that meshes therewith. The main drive gear 19 and pinion 21*a*** of the lower gearbox are cyclopalloid spiral bevel gears, and bearings are used that give long trouble-free life in oil-rig and similar applications. Pitch actuation is accomplished by means of an hydraulic servomotor.

The thruster is mounted to double skins 25, 26 of the bottom of the vessel by means of a sealing tube 28 that is welded between the skins 25,26 and has a flange 29 at its lower end. A steering gearbox 30 of the thruster has a case defined by an upper portion 31 bolted to a lower portion 32 which has a flange 34 that makes face to face contact with the flange 29 of the sealing tube. The steering gearbox 30 is held in place by bolts 35 that pass through the flange 29 and threadedly engage bores in the flange 34. The mounting bolts 35 are accessed from inboard of the vessel by means of access tubes 36, there being typically about 24 such tubes 36 and bolts 35 distributed about the sealing tube 28.

The upper portion 31 of the steering gearbox case has attached thereto an oil transfer box casing 38 within which there is supported a stub shaft 40. Pressure oil for actuation of the servomotor and oil for cooling and lubrication of the lower gearbox is fed via the oil transfer box to the thruster unit. The stub shaft 40 is attached to a steering shaft 42 that has at its lower end a flange 43 attached to a top flange 44 of a pod stem 45 of the lower gearbox housing 46. The intermediate drive shaft 16 passes through the stub shaft 40 and is supported by a rolling contact bearing 41. The steering shaft 42 is supported in the portions 31, 32 of the gearbox case by means of rolling contact bearings 49, 50. A shaft seal 51 prevents ingress of water between the steering shaft 42 and the lower gearbox case 32.

Secured to the shaft 42 is a steering gear wheel 55 that meshes with diametrically opposed spur pinions 56, 57 supported in the gearbox case by respective upper and lower bearings 58, 59. In the illustrated design there are two of the pinions 56, 57 but if desired more than two pinions may be used. The pinions 56, 57 are attached by couplings 60, 61 to respective drive shafts 62, 63 that are driven by steering motors 64 which may be hydraulic motors or geared electric motors (FIG. **2*a***) to rotate the thruster unit at an azimuth speed of 1.5–3 rpm depending upon its size.

The gearbox casing can be supported from the vessel by means of a single lifting wire 66 that passes through a guide tube 67 and is secured to a bracket 68 attached to the lower portion 32 of the gearbox casing or alternatively to a bracket attached to the lower gear housing 46 or to its end cover 47.

In service rotation of the shaft 12 is transmitted to the propeller 22 via the lower gear box. The attitude of the thruster 18 relative to the vessel may be adjusted by operation of the motors 64 that rotate pinions 56, 57 and hence the steering shaft 42 and the steering angle is detected by a rotary transducer 70 or similar device. When the thruster is to be removed from the vessel a platform 72 that mounts the hydraulic motors 64 is disconnected from the ship's bottom 25, the couplings 60, 61 to pinions 56, 57 are released and the platform 72 carrying motors 64 and shafts 62, 63 is raised to the position shown in FIG. 2B. The main drive shaft 12 is removed. A pair of protective caps 73 is fitted to the upper portion 31 of the gear box cover to seal off the apertures therein leading to pinions 56, 57 and they also serve to lock pinions 56, 57 to the fixed case to prevent accidental rotation of the thruster unit. The electrical connector assembly including the position detector 70 is then removed and a protective cap 74 is fitted to the top of the steering unit. An inner sealing plate 75 that normally forms an inner watertight seal to the gearbox casing is released therefrom and a top sealing plate 76 is fitted to the top of the sealing tube 28. The cavity is pressure tested to ensure that the plate 76 is secure, after which the lifting wire 66 is attached to the bracket 68. A mounting frame 80 is attached to the nozzle 23 and is pivoted at 81 to the side of the vessel. A lifting wire 82 is shackled to the frame 80 as shown. The bolts 35 are then released and the thruster unit is swung downwardly under the guidance of the frame 80 and controlled by the lift wire 66 as in FIG. 2B until the thruster unit is clear of the ship's side. The wire 66 is disconnected and the thruster unit is lifted from the water.

The arrangement of FIG. 3 is similar to that of FIG. 2 except that the thruster is mounted further from the side of the vessel or from one end of the vessel. A control wire is again attached to the lower portion 32 of the steering gearbox casing or alternatively to a bracket attached to the lower gear housing 46 or its end cover 47. During removal the nozzle 23 is attached to a carriage 90 that runs on a guide rail 91 to a location outboard of the vessel and then lifted from the water.

It will be appreciated that because the steering gearbox and thruster are provided as a modular unit the demounting procedure is much quicker and easier than conventional thrusters where the steering mechanism is retained within the ships structure. The use of a lifting frame gives better control of the mounting and demounting operation and permits this to be done under more arduous conditions and/or in shallower water.

I claim:

1. A vessel having a hull and a submerged propeller unit demountably fitted to the hull and continuously rotatable through 360° of azimuth relative to the hull to give full thrust in any required direction, comprising means defining an aperture in the hull of the vessel surrounded by a fixing flange, a drive input shaft for the propeller unit and at least one steering drive shaft, at least one steering drive motor mounted in the vessel and connected to the steering drive shaft to effect rotation thereof, a casing that fits in the aperture from under the hull with a circumferential flange releasably bolted to the underside of the fixing flange, a stem depending from said casing and rotatably supported therein at its upper end to act as a steering tube for a propeller rotatably supported at its lower end, a steering gear wheel in said casing through which the stem passes and to which gear wheel the stem is connected so as to rotate therewith, steering drive gear means rotatably supported in said casing in mesh with the steering gear wheel and releasably connected to said steering drive shaft via an opening in said casing that can be closed by an intended protective cap so that operation of said steering motor rotates the propeller unit, and a drive transmission shaft for the propeller extending through the stem and releasably connected at its upper end to the drive input shaft via a further opening in said casing that can be closed by an intended protective cap so that the propeller unit can be dismounted from under the hull of the vessel with the protective caps in place, the steering gear wheel and the gear means being removed in the casing as part of the demountable propeller unit.

2. A vessel according to claim 1, wherein said hull is formed with inner and outer skins in each of which said aperture is formed, a sealing tube fits in said aperture between said skins and is water-tightly attached thereto, and an annular inner sealing plate extends horizontally into said aperture from an inner face of said sealing tube at a vertical position between the inner and outer skins and attaches to said casing.

3. A vessel according to claim 1, wherein during dismounting of said propeller unit, means serves to lock said steering drive gear means to said casing to prevent accidental rotation of said thruster unit.

4. A vessel having a hull and a submerged propeller unit demountably fitted to the hull and continuously rotatable through 360° of azimuth relative to the hull to give full thrust in any required direction, comprising means defining an aperture in the hull of the vessel surrounded by a fixing flange, a drive input shaft for the propeller unit and at least one steering drive shaft, at least one steering drive motor mounted in the vessel and connected to the steering drive shaft to effect rotation thereof, a casing that fits in the aperture with a circumferential flange releasably bolted to the fixing flange, a stem depending from said casing and rotatably supported therein at its upper end to act as a steering tube for a propeller rotatably supported at its lower end, a steering gear wheel in said casing through which the stem passes and to which it is secured so as to effect rotation thereof, a steering drive gear means rotatably supported in said casing in mesh with the steering drive wheel and releasably connected to said steering drive shaft so that operation of said steering motor rotates the propeller unit, and a drive transmission shaft for the propeller extending through the stem and releasably connected at its upper end to the drive input shaft whereby when the propeller unit is dismounted from the vessel the steering gear wheel and the gear means are removed in the casing as part of the demountable propeller unit; an inner sealing plate at a vertical position between inner and outer skins of the hull attaches to said casing; access tubes from within the vessel lead through the inner skin of the hull to fixing bolts that pass downwardly through apertures in the fixing flange and threadedly engage bores in the circumferential flange of the casing; and the or each steering drive motor is fixed to a platform mounted for vertical movement so that in demounting the propeller unit the or each drive motor may be raised to lift the or each steering drive shaft clear from the aperture.

5. A vessel according to claim 4 wherein there are two steering drive motors disposed to opposite sides of the drive input shaft and driving respective steering drive shafts.

6. A vessel according to claim 5, wherein the steering drive gear means are pinions supported in the casing for rotation about a vertical axis and releasably connected to the steering drive shafts.

7. A vessel according to claim 6, wherein the stem is supported in the casing by means of upper and lower rolling contact bearings and the steering drive gear is disposed between the said bearings.

8. A vessel according to claim 7, further comprising a first protective cap to fit over an opening into said casing for the main drive shaft and at least a second protective cap to fit over the or each opening into said casing for the or each steering drive shaft.

9. A vessel according to claim 8, wherein the propeller unit has an attachment point for a single control wire in a pipe extending downwardly through the hull of the vessel adjacent the aperture.

10. A vessel according to claim 9, further comprising a demount support frame attached to the nozzle and pivoted to the hull of the vessel at an outboard location to enable the propeller unit to swing outboard before being lifted from the water.

11. A vessel having a hull and a submerged propeller unit demountably fitted to the hull and continuously rotatable through 360° of azimuth relative to the hull to give full thrust in any required direction, comprising means defining an aperture in the hull of the vessel surrounded by a fixing flange, a drive input shaft for the propeller unit and at least one steering drive shaft, at least one steering drive motor mounted in the vessel and connected to the steering drive shaft to effect rotation thereof, a casing that fits in the aperture with a circumferential flange releasably bolted to the fixing flange, a stem depending from said casing and rotatably supported therein at its upper end to act as a steering tube for a propeller rotatably supported at its lower end, a steering gear wheel in said casing through which the stem passes and to which it is secured so as to effect rotation thereof, steering drive gear means rotatably supported in said casing in mesh with the steering drive wheel and releasably connected to said steering drive shaft so that operation of said steering motor rotates the propeller unit, and a drive transmission shaft for the propeller extending through the stem and releasably connected at its upper end to the main drive shaft whereby when the propeller unit is dismounted from the vessel the steering gear wheel and the gear means are removed in the casing as part of the demountable propeller unit; and further comprising a demount rail pivoted to the vessel adjacent the aperture having a carriage that travels therealong and arranged for attachment to the shroud, a first control wire in a pipe extending downwardly through the hull of the vessel attached to the flange of the casing at a location opposite to the shroud and a second control wire attached adjacent a free end of the demount rail outboard of the vessel whereby, during demounting the propeller unit, the propeller unit may be lowered under the control of the first control wire until it hangs freely, after which the carriage may be moved along the demount rail until the propeller unit is outboard of the vessel.

* * * * *